US005349312A

United States Patent [19]

Huettner et al.

[11] Patent Number: 5,349,312

[45] Date of Patent: Sep. 20, 1994

[54] VOLTAGE VARIABLE ATTENUATOR

[75] Inventors: Steven E. Huettner, Billerica, Mass.; Maureen A. Daly, Pelham, N.H.; Derek J. Fitzgerald, Lincoln, Mass.

[73] Assignee: Raytheon Company, Lexington, Mass.

[21] Appl. No.: 68,911

[22] Filed: May 28, 1993

[51] Int. Cl.[5] ..... H01P 1/22

[52] U.S. Cl. ..... 333/81 A; 333/109

[58] Field of Search ..... 333/117, 81 R, 81 A, 333/109, 116; 307/554, 568

[56] References Cited

U.S. PATENT DOCUMENTS

| | | | |
|---|---|---|---|
| 4,301,432 | 11/1981 | Carlson et al. | 333/164 |
| 4,787,686 | 11/1988 | Tajima et al. | 307/568 |
| 4,806,888 | 2/1989 | Salvage et al. | 333/138 |
| 5,081,432 | 1/1992 | Devlin et al. | 332/103 |

FOREIGN PATENT DOCUMENTS

| | | |
|---|---|---|
| 0102602 | 5/1987 | Japan . |
| 0154602 | 6/1989 | Japan . |

OTHER PUBLICATIONS

"Interdigitated Stripline Quadrature Hybrid," IEEE Transactions on Microwave Theory and Techniques, Dec. 1969, pp. 1150–1151.

"A 2 to 8 GHz Leveling Loop Using A GaAs MMIC Active Splitter and Attenuator," G S. Barta et al., CH2326-7/86/0000-007 IEEE, 1986, pp. 75–79.

"Surface-Mounted GaAs Active Splitter and Attenuator MMIC's Used in a 1–10-GHz Leveling Loop," Bary S. Barta et al., IEEE Transactions on Microwave Theory and Techniques, vol. MTT-34, No. 12, Dec. 1986, IEEE Log No. 8611163, pp. 1569–1575.

"A Temperature-Compensated Linearizing Technique for MMIC Attenuators Utilizing GaAs MESFETS as Voltage-Variable Resistors," D. A. Fisher et al., CH2848-0/90/0000-0781 IEEE 1990, pp. 781–784.

"1-6 GHz GaAs MMIC Linear Attenuator With Integral Drives," G. Lizama et al., 0149-645X/87/00-00-0097, IEEE 1987, pp. 97–99.

"A Novel, Linear Voltage Variable MMIC Attenuator," Barak Maoz, IEEE Transactions on Microwave Theory and Techniques, vol. 38, No. 11, Nov. 1990, pp. 1675–1683.

"Broadband Phase Invariant Attenuator," D. Adler et al., 0149-645X/88/0000-0673 IEEE MTT-S Digest, 1988, pp. 673–676.

Series D197 Voltage Controlled Phase Invariant Attenuators, Spec Sheet, pp. 37–39.

*Primary Examiner*—Robert J. Pascal

*Assistant Examiner*—Darius Gambino

*Attorney, Agent, or Firm*—Donald F. Mofford; Richard M. Sharkansky

[57] ABSTRACT

A voltage variable attenuator is described including a quadrature hybrid coupler having an input port, an output port, a first reflective port and a second reflective port. The voltage variable attenuator further includes a first and a second impedance network, the first impedance network connected to the first reflective port of the quadrature hybrid coupler, the second impedance network connected to the second reflective port of the quadrature hybrid coupler, each impedance network including a first RF propagation network having a first end connected to the respective reflective port of the quadrature hybrid coupler. Each impedance network further includes a second end of the first RF propagation network connected to a field effect transistor having a drain electrode, a source electrode and a gate electrode, the drain electrode connected to the second end of the first RF propagation network. Completing each impedance network is a second RF propagation network having a first end connected to the source electrode and a second electrode connected to a ground through a plated via hole.

13 Claims, 9 Drawing Sheets

VOLTAGE VARIABLE ATTENUATOR

This invention was made with Government support under Contract No. N00019-89-C-0218 awarded by the Department of the Navy. The Government has certain rights in this invention.

BACKGROUND OF THE INVENTION

This invention relates to voltage variable attenuators and more particularly to reflection type voltage variable attenuators used in microwave signal processing applications.

As is known in the art, a voltage variable attenuator is a device having an input port, an output port and a control port and provides a predetermined amount of attenuation to a signal propagating between the input port and the output port as determined by a control voltage fed to the control port. Typically, voltage variable attenuators are continuously variable over a predetermined attenuation range while providing a required operational bandwidth and impedance match. In microwave signal processing attenuator to operate from a single control voltage and to provide a linear voltage vs. attenuation response. It is also desirable to consume minimal direct current (DC) power when providing the control voltage signal. It is further desirable to provide attenuation to a signal with a minimum variation in signal phase shift.

Various types of voltage variable attenuators have been implemented using monolithic microwave integrated circuit (MMIC) technology. For example, tee type, pi type and bridge tee type attenuators have been implemented using monolithic microwave integrated circuit (MMIC) technology. One type of voltage variable attenuator implemented using MMIC technology includes a GaAs (gallium arsenide) MMIC attenuator such as a Triquint 9161 manufactured by Triquint Semiconductor, Inc. of Beaverton, Ore.

One type of a voltage variable attenuator (VVA) is known as a reflection VVA. A reflection VVA typically includes a quadrature coupler having an input port and an output port and a pair of coupled ports. A pair of matched variable termination devices are connected respectively to the pair of coupled ports. As signals are fed to the input port, the signals are attenuated by the amount of power absorbed by the pair of matched variable termination devices and the remaining signals are reflected toward the output port. An example of such a device is an attenuator having a part series no. D197 manufactured by General Microwave, Inc. of 5500 New Horizons Blvd., Amityville, N.Y. This attenuator is manufactured as a hybrid circuit on an alumina substrate requiring a plurality of PIN diodes and complex driver circuitry to provide the required current to drive the PIN diodes.

Unfortunately, known types of MMIC implemented voltage variable attenuators are non-linear and typically require two control voltages to provide a required impedance match. Furthermore, each device usually requires characterization testing to determine optimum control voltages for that device. Although various techniques for improving linearization and impedance matching have been utilized, such techniques are typically complex and require additional topography when implemented with MMIC technology. Furthermore, phase variation characteristics (i.e. at a fixed frequency, as the attenuation is varied, the amount of phase shift of a signal observed between the input port and the output port of the device) is often ignored with the above mentioned techniques.

SUMMARY OF THE INVENTION

With the foregoing background in mind, it is an object of this invention to provide a voltage variable attenuator requiring a single control voltage source.

Another object of this invention is to provide an impedance matching technique under all attenuation conditions, i.e. at any control voltage (or attenuation) value.

Another object of this invention is to provide a voltage variable attenuator having a near linear voltage per attenuation response characteristic.

Still another object of this invention is to provide a constant phase shift characteristic over the attenuation range.

A still further object of this invention is to provide a voltage variable attenuator consuming no DC power at the control port under typical operating conditions.

The foregoing and other objects of this inventions are met generally by a voltage variable attenuator including a quadrature hybrid coupler having an input port, an output port, a first reflective port and a second reflective port. The voltage variable attenuator further includes a first and a second impedance network, the first impedance network connected to the first reflective port of the quadrature hybrid coupler, the second impedance network connected to the second reflective port of the quadrature hybrid coupler, each impedance network including a first RF propagation network having a first end connected to the respective reflective port of the quadrature hybrid coupler. Each impedance network further includes a second end of the first RF propagation network connected to a field effect transistor having a drain electrode, a source electrode and a gate electrode, the drain electrode connected to the second end of the first RF propagation network. Completing each impedance network is a second RF propagation network having a first end connected to the source electrode and a second electrode connected to a ground through a plated via hole. With such an arrangement, an impedance network is provided which provides a constant phase with changing attenuation in response to a control voltage and consumes little, if not no direct current power.

In accordance with another aspect of the present invention, the field effect transistor includes a drain electrode, a first gate electrode disposed adjacent the drain electrode, and a combination source and drain electrode disposed adjacent the first gate electrode. The field effect transistor further includes a second gate electrode disposed adjacent the combination source and drain electrode and a source electrode disposed adjacent the second gate electrode. With the width of the gate electrode being 100 micrometers, the connection of the two separate field effect transistors in series provides a characteristic of a fifty micrometer field effect transistor with improved power handling. With such an arrangement, a field effect transistor (FET) is provided having a channel resistance per gate voltage characteristic which matches the required resistance vs. attenuation requirement for a reflection type voltage variable attenuator, the FET having a greater power handling capability which improves the power handling capability of the voltage variable attenuator.

BRIEF DESCRIPTION OF THE DRAWINGS

For a more complete understanding of this invention, reference is now made to the following description of the accompanying drawings, wherein.

DESCRIPTION OF THE PREFERRED EMBODIMENTS

Figure 1:
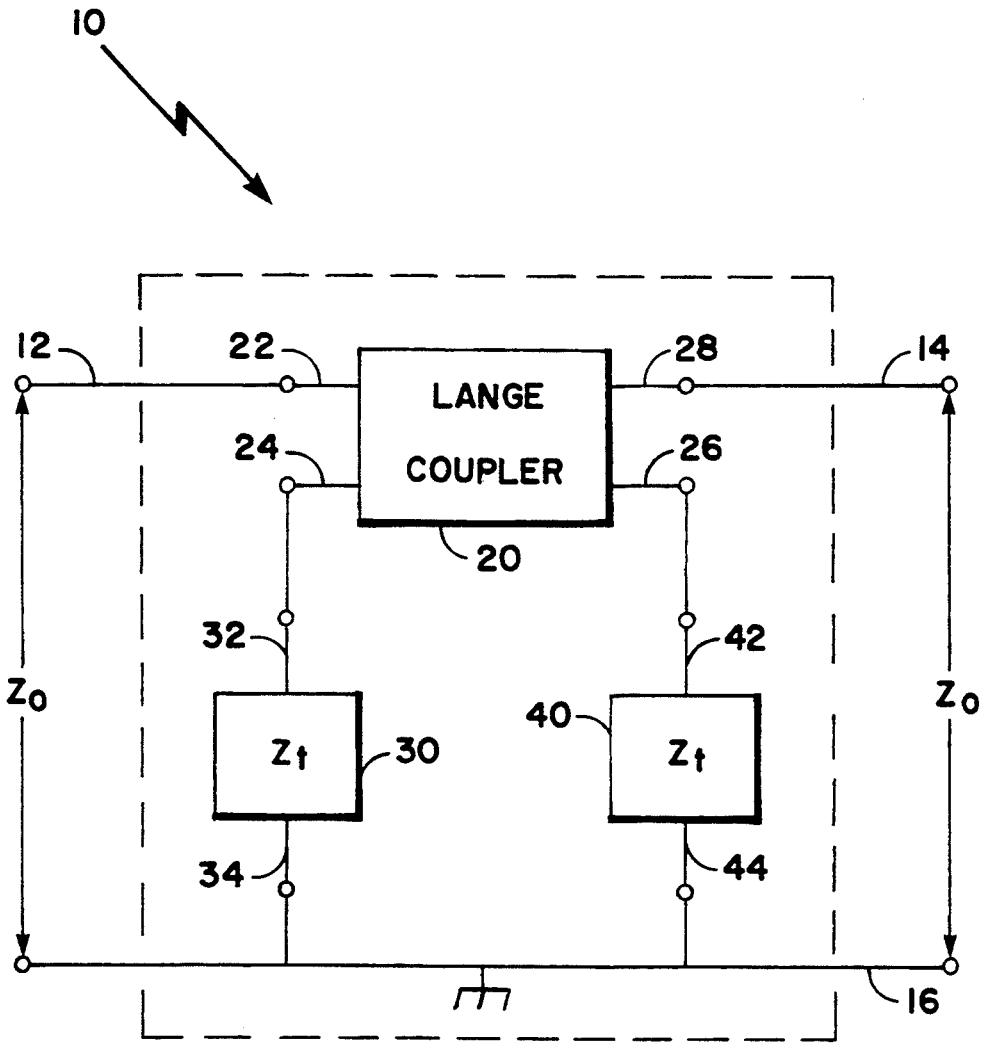
FIG. 1 is a block diagram of a voltage variable attenuator according to the invention.
Figure 1A:
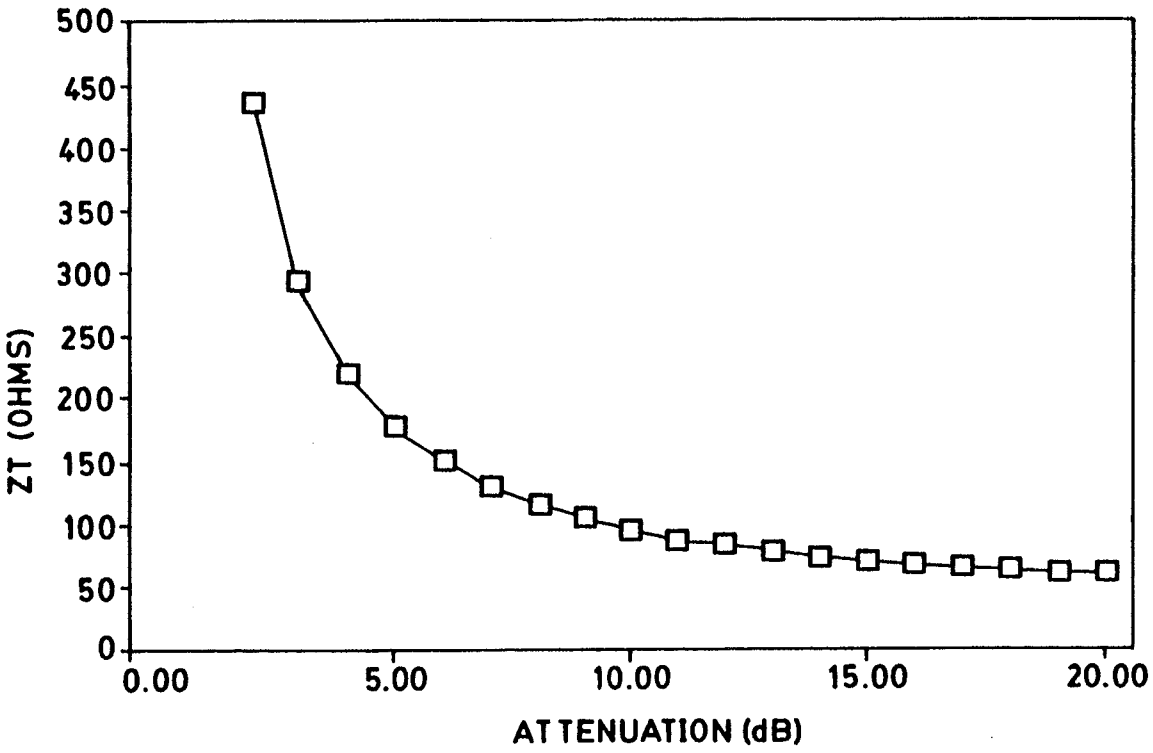
FIG. 1A is a plot of an ideal impedance vs. attenuation response characteristic of an impedance network of the reflection voltage variable attenuator according to the invention.

Referring now to FIG. 1, it may be seen that a voltage variable attenuator 10 is here shown to include an input port 12 and an output port 14, each port having a common ground connection 16. The input port 12 is connected to a port 22 of a four port quadrature coupler 20. The coupler 20, here a Lange coupler, includes the port 22 and a port 24, a port 26 and a port 28. The port 28 of the coupler 20 is connected to the output port 14 of the voltage variable attenuator 10. The port 24 is connected to an input port 32 of a termination 30 having also an output port 34 connected to the common ground connection 16. The port 26 is connected to an input port 42 of a termination 40 having also an output port 44 connected to the common ground connection 16. If the termination 30 and the termination 40 are constructed similar in manner to provide equal impedances to the coupler 20 and the coupler 20 provides an equal power split, then the amount of attenuation provided by the voltage variable attenuator 10 can be expressed as $$\text{Attenuation (dB)} = 20 \log \frac{Z_t + Z_O}{Z_t - Z_O} \qquad \text{Eq. 1}$$

where $Z_t$ is the impedance of termination 30 and of termination 40 and $Z_o$ is the characteristic impedance of the input port 12 and of the output port 14 as well as the coupler 20. Thus, when the impedance of the terminations 30, 40 are matched to the input port 12, then a maximum attenuation is provided and as the impedance of the terminations 30, 40 are varied to an infinite mismatch, the amount of attenuation is decreased until a minimum attenuation is provided. In an application wherein $Z_o$ is known (i.e. 500), by setting $Z_t$ to a predetermined amount, a respective amount of attenuation can be provided. It should be appreciated that two real solutions exist for Equation 1 when $Z_o$ is known to equal 500 and $Z_t$ is varied. A first solution is for the situation where $Z_t$ is greater than $Z_o$ and the second solution is for the situation where $Z_t$ is less than $Z_o$. It should be appreciated that various values of impedance can be selected for the termination 30 and the termination 40 and a plot of such a selection is shown in FIG. 1A for the situation where $Z_t$ is greater than $Z_o$ in accordance with equation 1.

In the realization of the invention, the impedances of the terminations 30 and 40 are not necessarily truly equal, and it is necessary to consider this inequality on the voltage variable attenuator (VVA) 10 performance. Because of the configuration of the quadrature coupler within the reflection VVA, the reflection coefficient Γ (a measure of impedance match) presented at either the input port 12 or output port 14 of the VVA depends on the difference of the reflection coefficients $\Gamma_{30}$ and $\Gamma_{40}$ presented by the terminations 30 and 40:

$$\Gamma = \frac{\Gamma_{30} - \Gamma_{40}}{2}$$

Thus achieving an impedance-matched condition (low reflection coefficient) depends only on the relative equality of the reflection coefficients $\Gamma_{30}$ and $\Gamma_{40}$ of the terminations 30 and 40.

The transmission coefficient T (a measure of attenuation) from port 12 to port 14 of the VVA (and vice-versa because it is a reciprocal device) is equal to the average of the reflection coefficients $\Gamma_{30}$ and $\Gamma_{40}$ presented by the terminations 30 and 40:

$$T = \frac{\Gamma_{30} + \Gamma_{40}}{2}$$

The reflection (Γ) and transmission (T) coefficients of the VVA can be solved in terms of the termination impedances, $Z_{t30}$ and $Z_{t40}$, presented respectively at ports 30 and 40, as follows:

$$\Gamma_{t30} = \frac{Z_{t30} - Z_0}{Z_{t30} + Z_0}$$

$$\Gamma_{40} = \frac{Z_{t40} - Z_0}{Z_{t40} + Z_0}$$

The reflection (Γ) and transmission (T) coefficients of the VVA can be solved in terms of the termination impedances $Z_{t30}$ and $Z_{t40}$:

$$\Gamma = \frac{Z_0 (Z_{t30} - Z_{t40})}{(Z_{t30} + Z_0)(Z_{t40} + Z_0)}$$

$$T = \frac{Z_{t30} Z_{t40} - Z_0^2}{(Z_{t30} + Z_0)(Z_{t40} + Z_0)}$$

The impedance match of the device is tolerant to a relatively large difference in termination impedances. For example, if $Z_{t30}=1000$ and $Z_{t40}=2000$, a reflection coefficient of 0.13 (−17.5 dB) is provided, with a transmission coefficient of 0.46 (−6.6 dB). By realizing the invention on a single MMIC chip, the condition of equal 10 termination impedance is well met over all attenuation conditions because the channel resistance versus gate voltage characteristic of geometrically identical FETs that are physically close to each other on a GaAs wafer are likely to be very similar. Thus, the invention is inherently impedance matched.

In the case where the terminations are of equal impedance ($Z_{t30}=Z_{t40}=Z_t$), the VVA's reflection ($\Gamma$) and transmission (T) coefficients can be further simplified to:

$$\Gamma = 0$$

$$T = \frac{Z_t - Z_0}{Z_t + Z_0}$$

and the attenuation of the VVA in dB as expressed by Equation 1 is valid:

$$\text{Attenuation (dB)} = 20\log(1/T) = 20\log\frac{Z_t + Z_0}{Z_t - Z_0}$$

Figure 2:
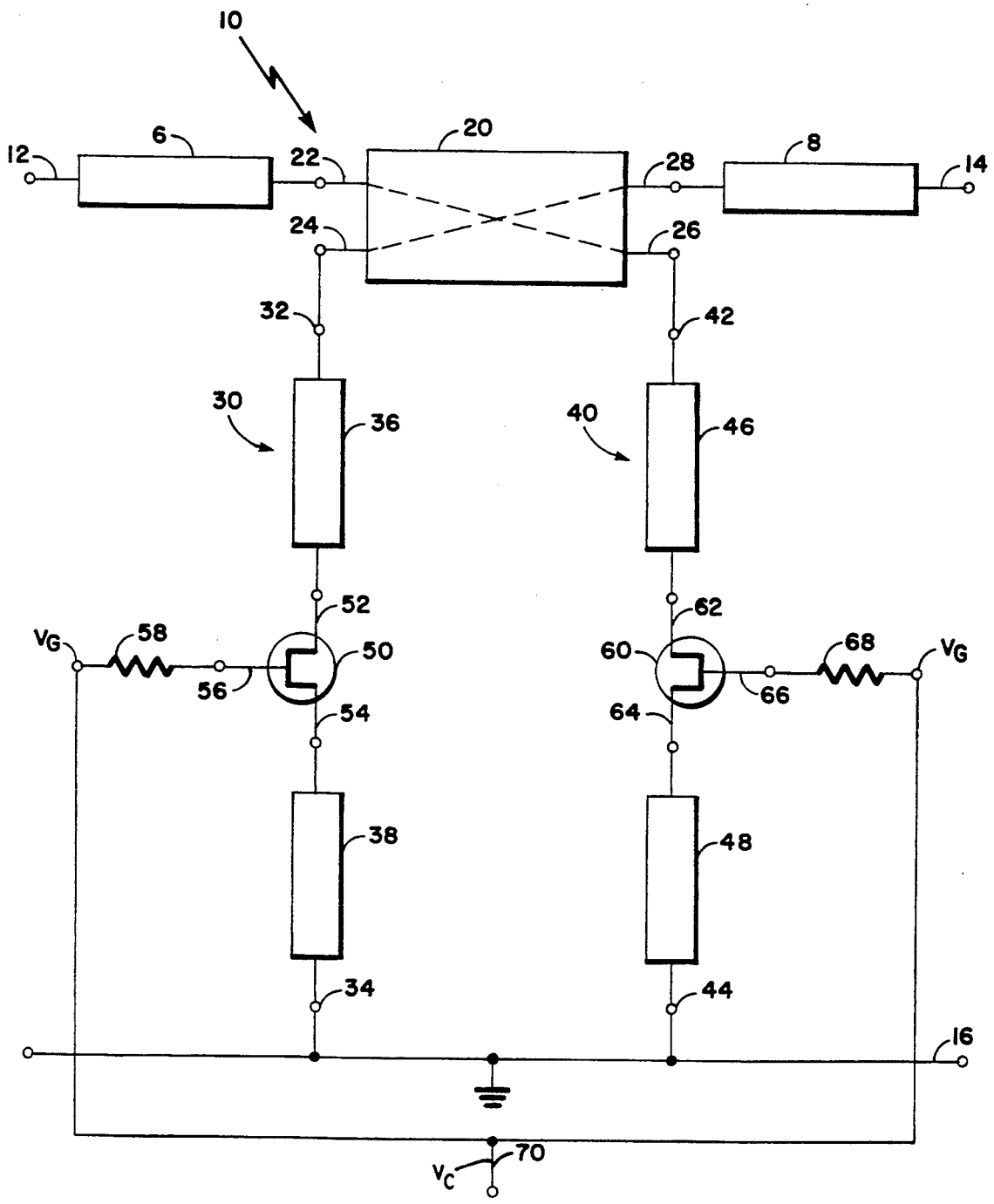
FIG. 2 is a schematic diagram of the voltage variable attenuator according to the invention.

Referring now to FIG. 2, the voltage variable attenuator 10 as described in connection with FIG. 1 is shown in more detail wherein like reference numerals indicate like elements. The input port 12 of the voltage variable attenuator 10 is connected to a first end of a RF propagation network 6 with a characteristic impedance of 50 ohms and having a second end connected to the port 22 of the coupler 20. As described earlier, the coupler 20 is a four port Lange coupler configured wherein the port 22 is an input port and the port 28 is an output port. The port 24 and the port 26 are the quadrature power split ports and operate in a manner as described further hereinafter. Within the coupler 20, the port 22 is directly connected to port 26 and is coupled, with one-half power coupling, to port 24. In a similar manner, port 28 is directly connected to port 24 and is coupled, with one-half power coupling, to port 26. The port 28 is connected to a first end of a RF propagation network 8 with a characteristic impedance of fifty ohms and having a second end connected to the output port 14 of the voltage variable attenuator 10.

The port 24 is connected to the input port 32 of the termination 30, the input port 32 being a first end of a RF propagation network 36. A second end of RF propagation network 36 is connected to a drain electrode 52 of a field effect transistor (FET) 50. The FET 50 is a MESFET type field effect transistor having a drain electrode 52, a source electrode 54 and a gate electrode 56 and operates in a manner as described further hereinafter. The source electrode 54 is connected to a first end of a RF propagation network 38 having also a second end connected to the output port 34 of the termination 30. The output port 34 is connected through a substrate (not shown) with a plated via hole (not shown) to the common ground connection 16. The gate electrode 56 of the FET 50 is connected to a first end of an RF isolation resistor 58 having also a second end which is connected to a control signal port 70.

In a similar manner, the port 26 of the coupler 20 is connected to the input port 42 of the termination 40, the input port 42 being a first end of a RF propagation network 46. It should be appreciated that elements of the termination 40 are constructed similar in manner to the elements of the termination 30. A second end of RF propagation network 46 is connected to a drain electrode 62 of a field effect transistor (FET) 60. The FET 60 is also a MESFET type field effect transistor having a drain electrode 62, a source electrode 64 and a gate electrode 66. The FET 60 is the same as the FET 50 and operates in a similar manner as described further hereinafter. The source electrode 64 is connected to a first end of a RF propagation network 48 having also a second end connected to the output port 44 of the termination 40. The output port 44 is connected through the substrate (not shown) to the common ground connection 16. The gate electrode 66 of the FET 60 is connected to a first end of an RF isolation resistor 68 having also a second end which is connected to the control signal port 70.

With the above described arrangement, if an RF signal is applied to the input port 12 of the voltage variable attenuator 10, the RF signal propagates, via RF propagation network 6, to the input port 22 of the coupler 20. The coupler 20 is a quadrature coupler and preferably a Lange coupler adapted to transfer entirely and equally, signals from the input port 22 to the reflective ports 24, 26 and further adapted to combine and transfer signals from the reflective ports 24, 26 to the output port 28. Thus, an RF signal fed to the input port 22 of the coupler 20 is equally split to the reflective ports 24, 26 with one-half of the RF signal fed to the RF propagation network 36 and one-half of the RF signal fed to the RF propagation network 46 with the respective signals at the ports 24, 26 being 90 degrees out of phase with each other (i.e. in quadrature with each other) .

The RF signal propagating into termination 30 is passed through the RF propagation network 36 and fed to the drain electrode 52 of the FET 50. The FET 50 is a MESFET type transistor and fabricated as described hereinafter in connection with FIG. 3A. Suffice it to say here that the channel resistance of the FET 50 is adapted to vary with a gate voltage applied to the gate electrode 56 as necessary to provide the resistance required to approximate a resistance curve as described hereinabove required for the terminations 30, 40. By optimizing the gate periphery (i.e. FET size) and pinch-off voltage of the MESFET, the resistance/voltage characteristics of the FET can be matched to the resistance/attenuation requirements of termination 30 and termination 40. Thus, the impedance (i.e. resistance) provided by the FET 50 can be varied by changing the voltage applied to the gate 56. The source electrode 54 of the FET 50 is connected to the RF propagation network 38 which in turn is connected to the common ground connection 16. It should now be appreciated that the RF propagation network 36, the FET 50 and the RF propagation network 38 are the elements of the termination 30 and the combined impedance of the RF propagation network 36, the FET 50 and the RF propagation network 38 provide the resistance as required to attenuate signals reflected by termination 30. With the latter in mind, if a gate voltage is fed to the gate 56 of the FET 50 to provide a real resistance of 750 and wherein the impedance of the input port 12 is 500, 14.0 dB of attenuation is provided to a signal reflected by termination 30. Alternatively, if a gate voltage is fed to the gate 56 of the FET 50 to provide a real resistance of 3000 and wherein the impedance of the input port 12 is 500, 2.9 dB of attenuation is provided to a signal reflected by termination 30. It should be appreciated that a wide range of values of impedance can be provided by the FET 50 by varying the gate voltage of the FET 50.

In a similar manner, the RF signal propagating into termination 40 is connected through the RF propagation network 46 and fed to the drain electrode 62 of the FET 60. The FET 60 is also a MESFET type transistor and is identical to the FET 50. The impedance (i.e. resistance) provided by the FET 60 can also be varied by changing the voltage applied to the gate 66. The source electrode 64 of the FET 60 is connected to the RF propagation network 48 which in turn is connected to the common ground connection 16. It should now be appreciated that the RF propagation network 46, the FET 60 and the RF propagation network 48 are the elements of the termination 40 and the combined impedance of the RF propagation network 46, the FET 60 and the RF propagation network 48 provide the resistance as required to attenuate signals reflected by termination 40 and operate in a similar manner as described with termination 30.

Having described the signal flow, it should now be appreciated that a portion of the RF signal incident on termination 30 will be absorbed by the termination 30 and a remaining portion of this RF signal will be reflected by the termination 30 and propagate back into the coupler 20. In a similar manner, a portion of the RF signal incident on termination 40 will be absorbed by the termination 40 and a remaining portion of this RF signal will be reflected by the termination 40 and propagate back into the coupler 20. The signals, which are 90 degrees out of phase with each other at ports 24 and 26, are combined in phase at port 28 of the coupler 20 and fed to the output port 14 of the voltage variable attenuator 10.

Figure 2A:
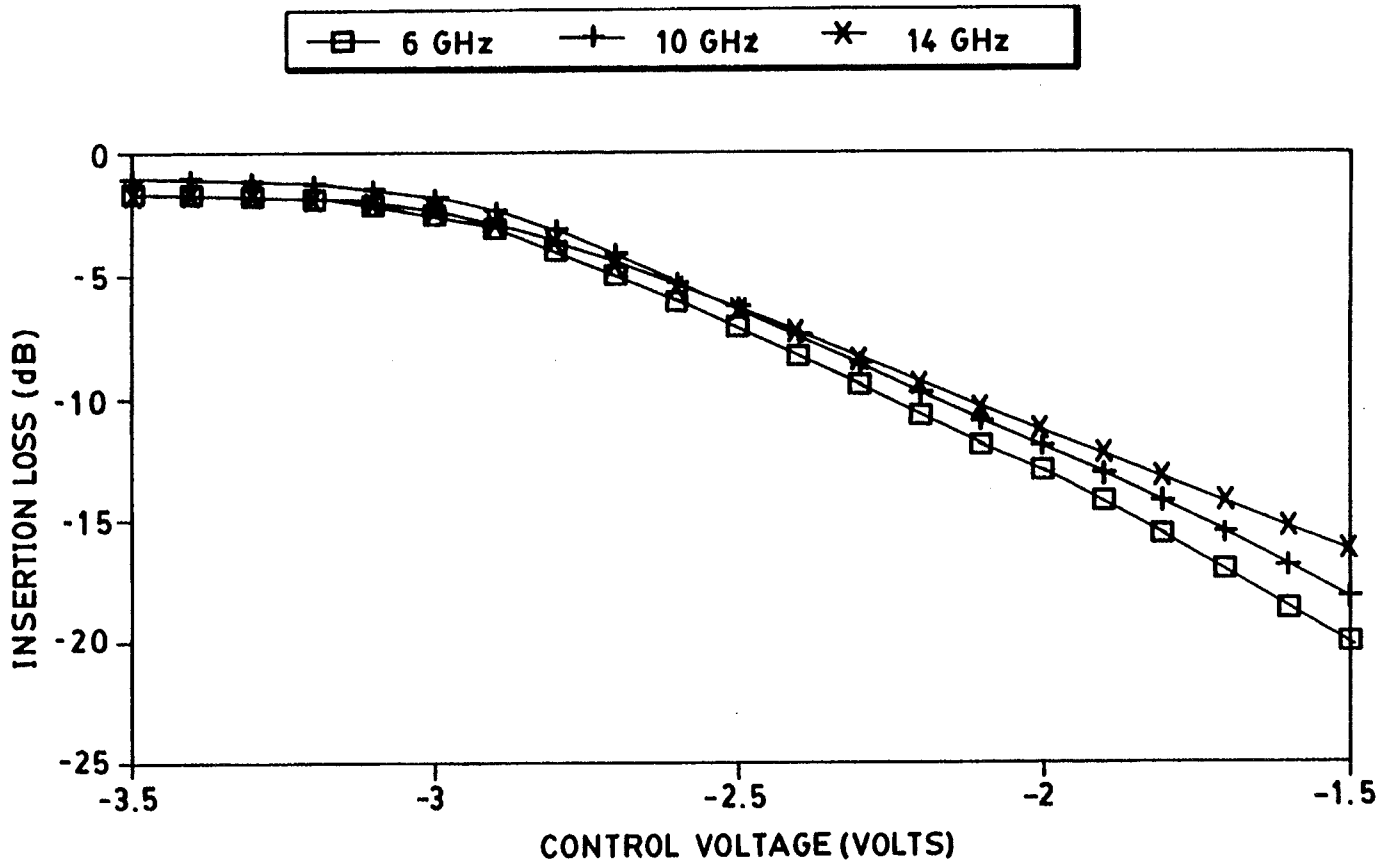
FIG. 2A is a plot of a voltage vs. attenuation response characteristic of the voltage variable attenuator according to the invention.

The amount of attenuation provided by the voltage variable attenuator 10 is dependent upon the amount of the RF signal that is absorbed by the terminations 30, 40 as controlled by the control voltage $V_c$. Thus, as the control voltage $V_c$ is varied, the impedance of the terminations 30, 40 will vary and the amount of the RF signal that is reflected by the terminations 30, 40 will vary thus controlling the amount of the RF signal appearing at the output port 14 of the voltage variable attenuator 10. Referring momentarily to FIG. 2A, a plot of the control voltage $V_c$ vs. attenuation is shown for three frequencies, here 6 GHz, 10 GHz and 14 GHz. It should be appreciated that the voltage variable attenuator 10 is a reciprocal device and a signal fed to the port 14 of the voltage variable attenuator 10 is attenuated as determined by the control voltage $V_c$ and an attenuated signal is provided at the port 12 of the voltage variable attenuator 10.

Figure 2B:
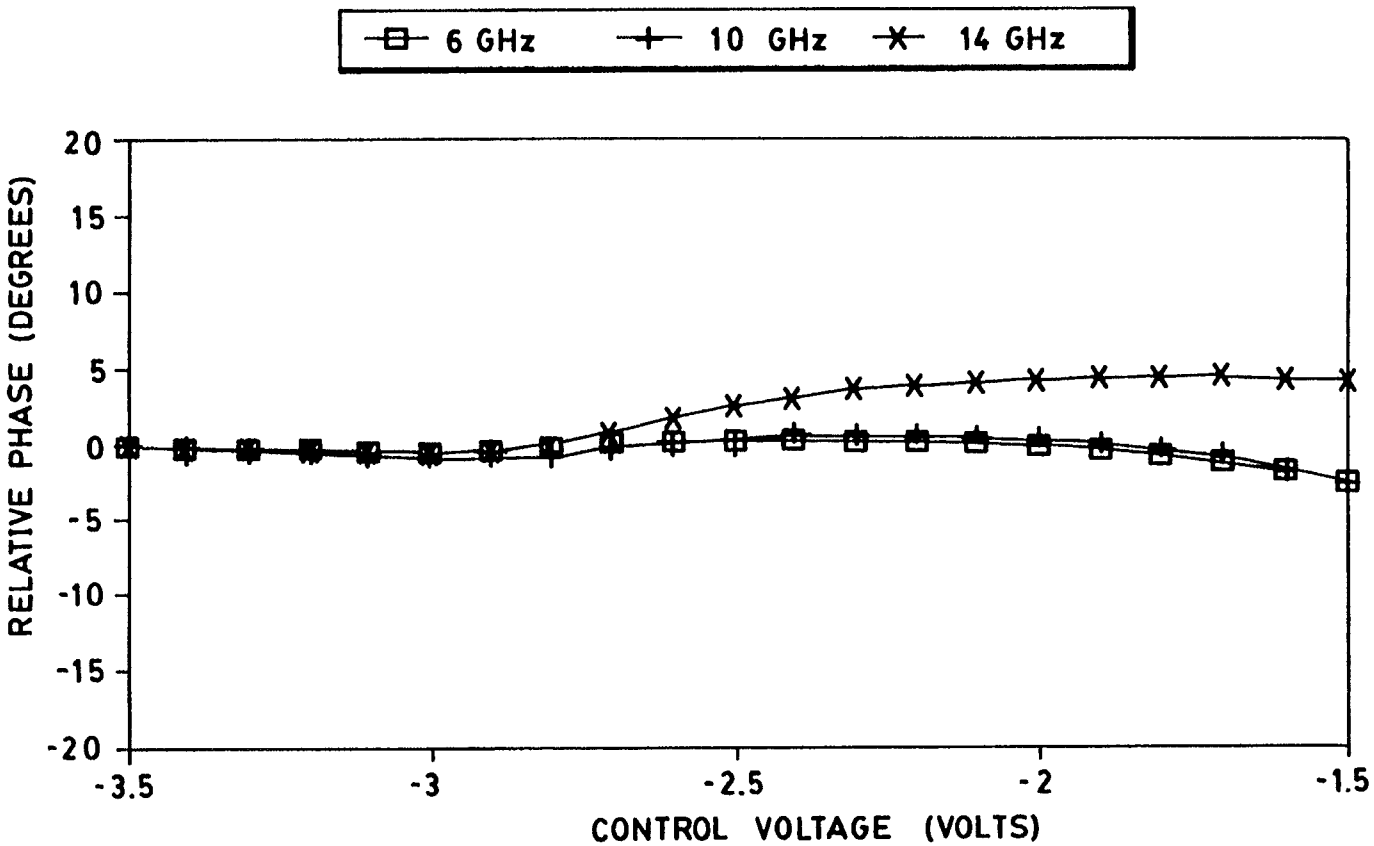
FIG. 2B is a plot of a voltage vs. phase variation response characteristic of the voltage variable attenuator according to the invention.

It should be appreciated that the FET's 50 and 60 have parasitic capacitances in shunt with their channel resistance, which causes an unacceptable phase variation to signals propagating through the FETs under different gate voltage (i.e. attenuation) conditions. The propagation networks 36 and 38 provide the proper reactive elements (i.e. inductors) to compensate for the FET's 50 internal capacitance. In a similar manner, the propagation networks 46 and 48 provide the proper reactive elements (i.e. inductors) to compensate for the FET's 60 internal capacitance. Such an arrangement results with terminations 30 and 40 having essentially zero phase shift variation with regard to the control voltage setting. Referring now to FIG. 2B, a plot of the control voltage $V_c$ vs. relative phase change in degrees is shown for three frequencies, here 6 GHz, 10 GHz and 14 GHz.

Figure 3:
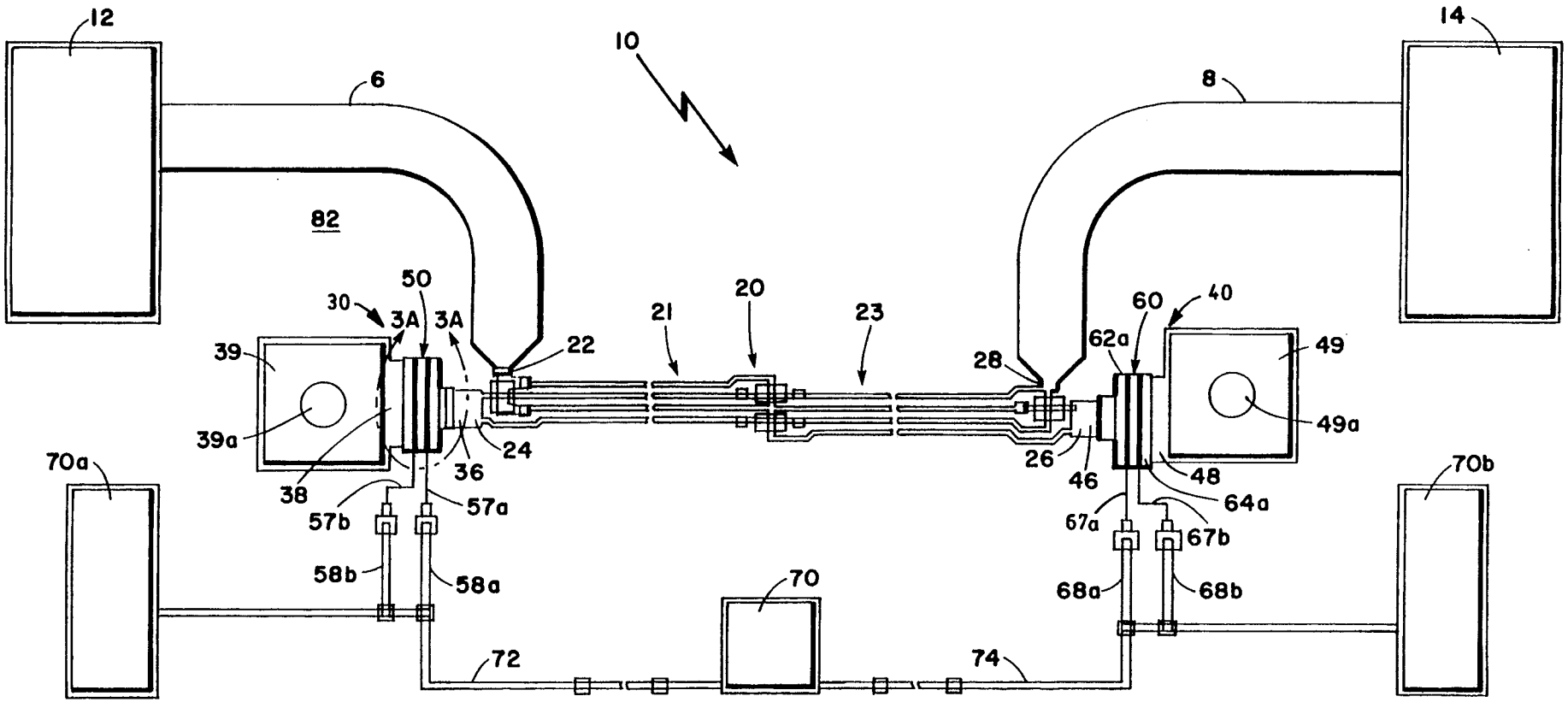
FIG. 3 is a plan view, somewhat distorted, of a monolithic circuit implementation of the voltage variable attenuator according to the invention.

Referring now to FIG. 3, the voltage variable attenuator 10 as described in connection with FIG. 2 is shown implemented as a monolithic circuit. The voltage variable attenuator 10 includes microstrip circuitry with strip conductors disposed on a substrate 82, here gallium arsenide (GaAs). The strip conductors are here provided using conventional photo-etching techniques. A conductive layer on an opposing surface of the substrate 82 provides the microstrip RF ground 16 (FIG. 2) for the monolithic circuit. The voltage variable attenuator 10 is fabricated on a 100 micrometer thick GaAs substrate. The chip size is 4.4 millimeter by 0.9 millimeters. The voltage variable attenuator 10 is designed to operate from 6 to 18 GHz, the bandwidth being limited to the bandwidth of the coupler 20 which is typically an octave.

The voltage variable attenuator 10 is adapted here to operate from a single source control voltage source having an output voltage varying from −3.5 volts to −1.5 volts of direct current. An input signal, here typically having a maximum level of 10 dBm, is fed to the input port 12 of the voltage variable attenuator 10, the connection to the input port 12 provided by a bonding pad. The RF propagation network 6 carries the input signal from the input port 12 to the input port 22 of the coupler 20. The width of the RF propagation network 6 is here 73 micrometers to provide a 50 ohm characteristic impedance and has a length of approximately 1.5 millimeters disposed as shown. The coupler 20 is a Lange type quadrature coupler wherein instead of the use of wires to provide cross-over connections in the interdigitated arrangement, conventional air-bridge fabrication processing is used to bridge strip conductors as shown. The width of each of the strip conductors of coupler 20 is here 5 micrometers. The spacing between adjacent ones of the strip conductors of the coupler 20 in the coupling region is here 8 micrometers. The total length of the strip conductors 21, 23 of the coupler 20 is 2700 micrometers (i.e. approximately $\sim\lambda_0/4$ in this media) for a coupler having a mid-band frequency of 10 GHz.

The output port 28 of the coupler 20 is connected to the RF propagation network 8 having similar dimensions as the RF propagation network 6, but disposed as a mirror image. It should be appreciated that the length of the RF propagation networks 6 and 8 is of no importance to the operation of the voltage variable attenuator 10. A bonding pad is connected to the RF propagation network 8 to provide the output port 14 of the voltage variable attenuator 10. The reflection ports 24 and 26 are connected to the terminations 30 and 40, respectively.

Figure 3A:
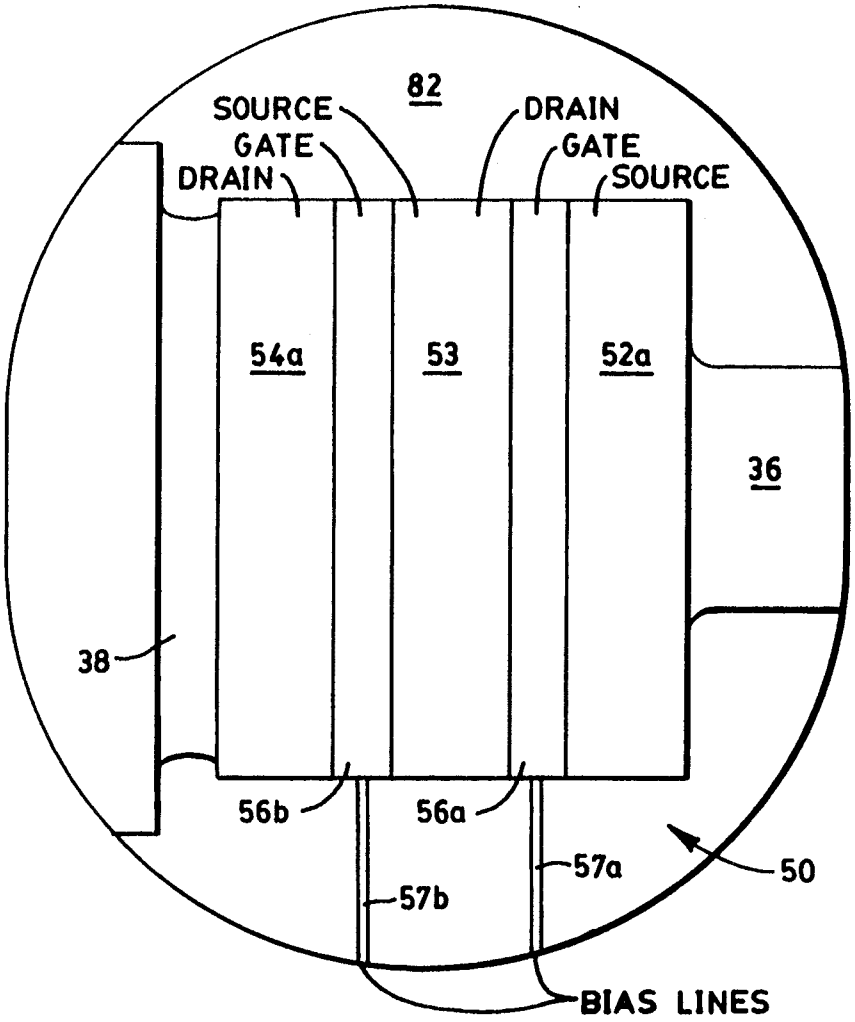
FIG. 3A is a plan view, partially broken away, of a portion of the plan view of FIG. 3, such portion being encircled by the arrow 3A—3A in FIG. 3.

Referring now to FIG. 3A, a more detailed view of the FET 50 is shown. It should be appreciated that FET 60 also is fabricated in a manner similar to FET 50, although the details of FET 60 are not shown. The FET 50 and FET 60, each provides a range of impedance values from approximately 50 ohms to open circuit. If a 50 μm periphery FET is used, each FET has a nominal saturated current of 16 milliamps, which would normally limit the power handling capability of the voltage variable attenuator 10 to approximately 26 mW or 13 mW per termination. However, by configuring the FET as two 100 μm FETs in series to obtain a 50 μm characteristic, a 6 dB improvement in power handling capability is provided (i.e. to 100 mW) because the saturated current of the resultant FET is doubled. The first FET of FET 50 is disposed with a drain electrode 52*a* connected to the RF propagation network 36. A gate electrode 56*a* of the first FET of FET 50 is disposed adjacent the drain electrode 52*a*. A common source/drain electrode 53 is disposed adjacent the gate electrode 56*a* and a gate electrode 56*b* of the second FET of FET 50 is disposed between the common source/drain electrode 53 and a source electrode 54*a* of the second FET of FET 50. With the above described arrangement, the FET 50 is provided with the drain electrode 52*a*, the gate electrode 56*a* and the common electrode 53 acting as a source electrode to the first FET and as a drain electrode for the second FET, the gate electrode 56*b* and the source electrode 54*a* providing a series configuration of two 100 μm FETs. The source electrode 54*a* is connected to the RF propagation network 38. A bias line 57*a* is connected to the gate electrode 56*a* to provide a control voltage to the gate electrode 56*a* of the first FET of FET 50 and a bias line 57*b* is connected to the gate electrode 56*b* of the second FET of FET 50 to provide a control voltage to the gate electrode 56*b*. As is known, by varying the width of the gate electrode with respect to the drain and source electrodes, the channel resistance characteristic as well as the parasitic capacitance of the FET can be controlled. By selecting the proper gate periphery, doping the FET appropriately and controlling the gate recess, a resistance vs. control voltage response curve can be tailored to match the required curve for the voltage variable attenuator 10. Thus, in the "fully on" state, the channel resistance of the FET 50 is optimized at 50 ohms and as the gate voltage is changed, the channel resistance of the FET 50 is changed accordingly.

Referring again to FIG. 3, the RF propagation network 38 is connected to a pad 39 which includes a via hole 39*a* which is connected to the conductive layer on the opposing surface of the substrate 82 to provide a connection to the common signal ground connection 16 (FIG. 2). The control signal port 70 is provided by a bonding pad as shown. A bias line 72 connects the control signal port 70 to an RF isolation resistor 58*a* which is connected to the bias line 57*a* to provide the control voltage to the gate electrode 56*a* (FIG. 3A). The bias line 72 also connects the control signal port 70 to an RF isolation resistor 58*b* which is connected to the bias line 57*b* to provide the control voltage to the gate electrode 56*b* (FIG. 3A). The bias line 72 is also connected to another pad 70*a* to provide an alternative connection for the control signal input. A bias line 74 also connects a pad 70*b* to the control signal port 70 to provide a second alternative connection for the control signal input.

Figure 4:
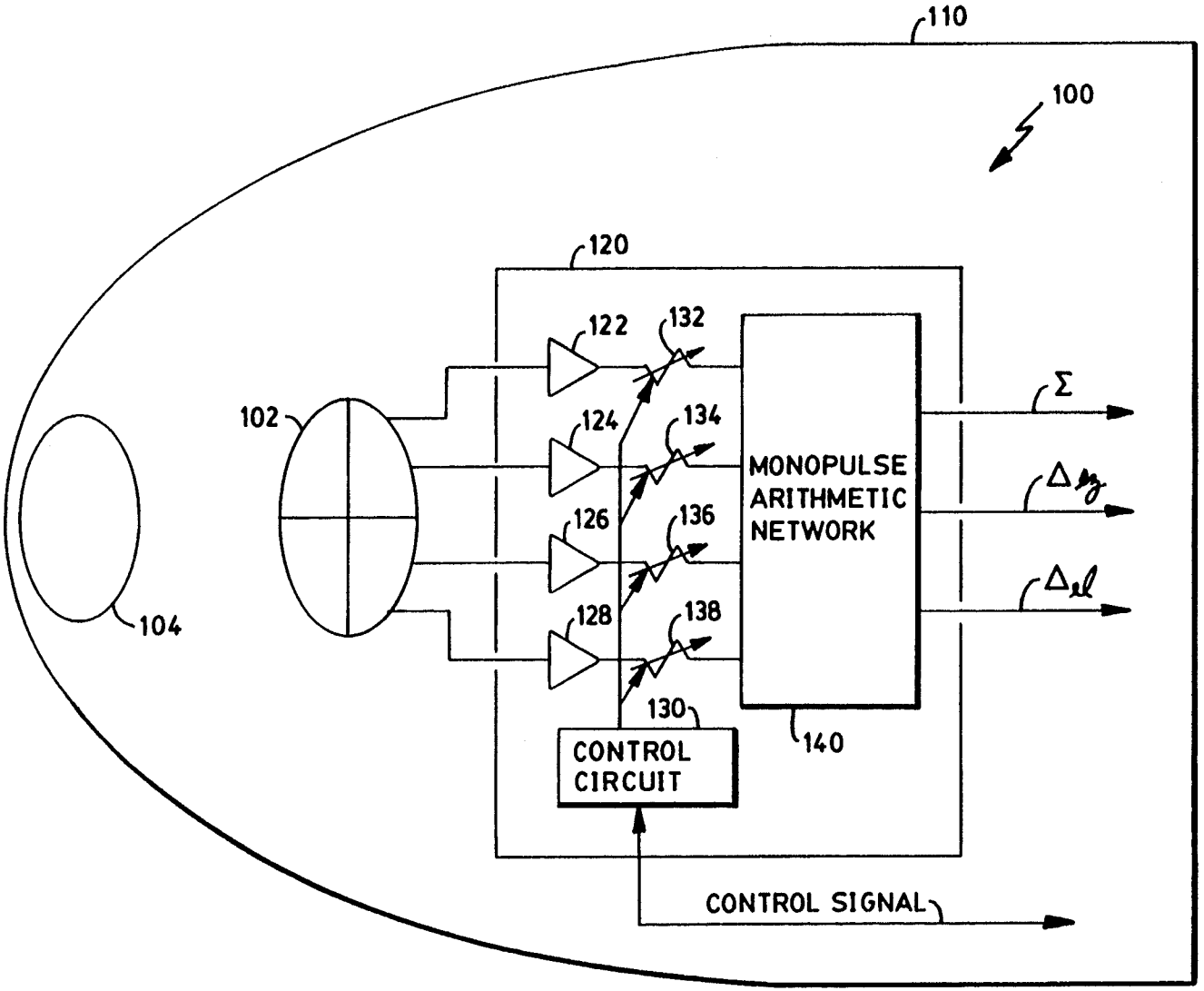
FIG. 4 is a block diagram of a portion of a missile seeker wherein a voltage variable attenuator according to the invention is implemented as part of a MMIC module used within the missile seeker.

In a similar manner, the RF propagation network 46 is connected to the reflection port 26 of the coupler 20. The RF propagation network 46 is connected to a drain electrode 62*a* of the FET 60. Although not shown in detail, the FET 60 is fabricated similar to the FET 50 so that the FET 60 is matched with the FET 50. The source electrode 64*a* of the FET 60 is connected to the RF propagation network 48. The RF propagation network 48 is connected to a bonding pad 49 which includes a via hole 49*a* which is connected to the conductive layer on the opposing surface of the substrate 82 to provide a connection to the common signal ground connection 16 (FIG. 2). The bias line 74 connects the control signal port 70 to an RF isolation resistor 68*a* which is connected to the bias line 67*a* to provide the control voltage to a gate electrode (not numbered) of the first FET of the FET 60. The bias line 74 also connects the control signal port 70 to an RF isolation resistor 68*b* which is connected to the bias line 67*b* to provide the control voltage to a second gate electrode (not numbered) of the second FET of the FET 60. The resistors 58*a*, 58*b*, 68*a*, 68*b* are provided to prevent RF energy from straying out of the FETs 50 and 60 and into a control circuit 130 (FIG. 4). It should be appreciated that the resistors 58*a*, 58*b*, 68*a*, 68*b* are fed from a common control voltage which can be provided at the control signal port 70 or alternatively at the bonding pad 70*a* or the bonding pad 70*b*.

Referring now to FIG. 4, a block diagram of a portion of a seeker 100 for a missile 110 implementing four voltage variable attenuators according to the invention is shown. Here a MMIC module 120 includes four low noise amplifiers (LNA) 122, 124, 126, 128, each LNA having an input connected to a corresponding quadrant segment of a monopulse antenna 102. The output of each of the LNAs 122, 124, 126, 128 is connected to an input of a corresponding voltage variable attenuator 132, 134, 136, 138 constructed according to the present invention as described in connection with FIGS. 3 and 3A. The output of each of the voltage variable attenuators 132, 134, 136, 138 is connected to a corresponding input of a monopulse arithmetic network 140 to provide a sum signal, an azimuth difference signal and an elevation difference signal for the seeker 100 in accordance with known techniques. A control circuit provides a control voltage to each of the voltage variable attenuators 132, 134, 136, 138 as required to control the respective voltage variable attenuator to provide the requisite attenuation as selected from a control signal from a signal processor (not shown). With an infra-red seeker 104 located in front of the monopulse antenna 102 causing an undesirable blockage of RF energy from a target (not shown), voltage variable attenuators 132, 134, 136, 138 can be used to reconstruct the requisite monopulse null. Such a technique is viable only if the voltage variable attenuators 132, 134, 136, 138 have minimal phase shift variation error over the required range of attenuation as provided in the above described invention. Furthermore, the disclosed technique provides a desirable embodiment for missile applications wherein size constraint is an important factor and a single control voltage minimizes control circuitry requirements.

Figure 5:
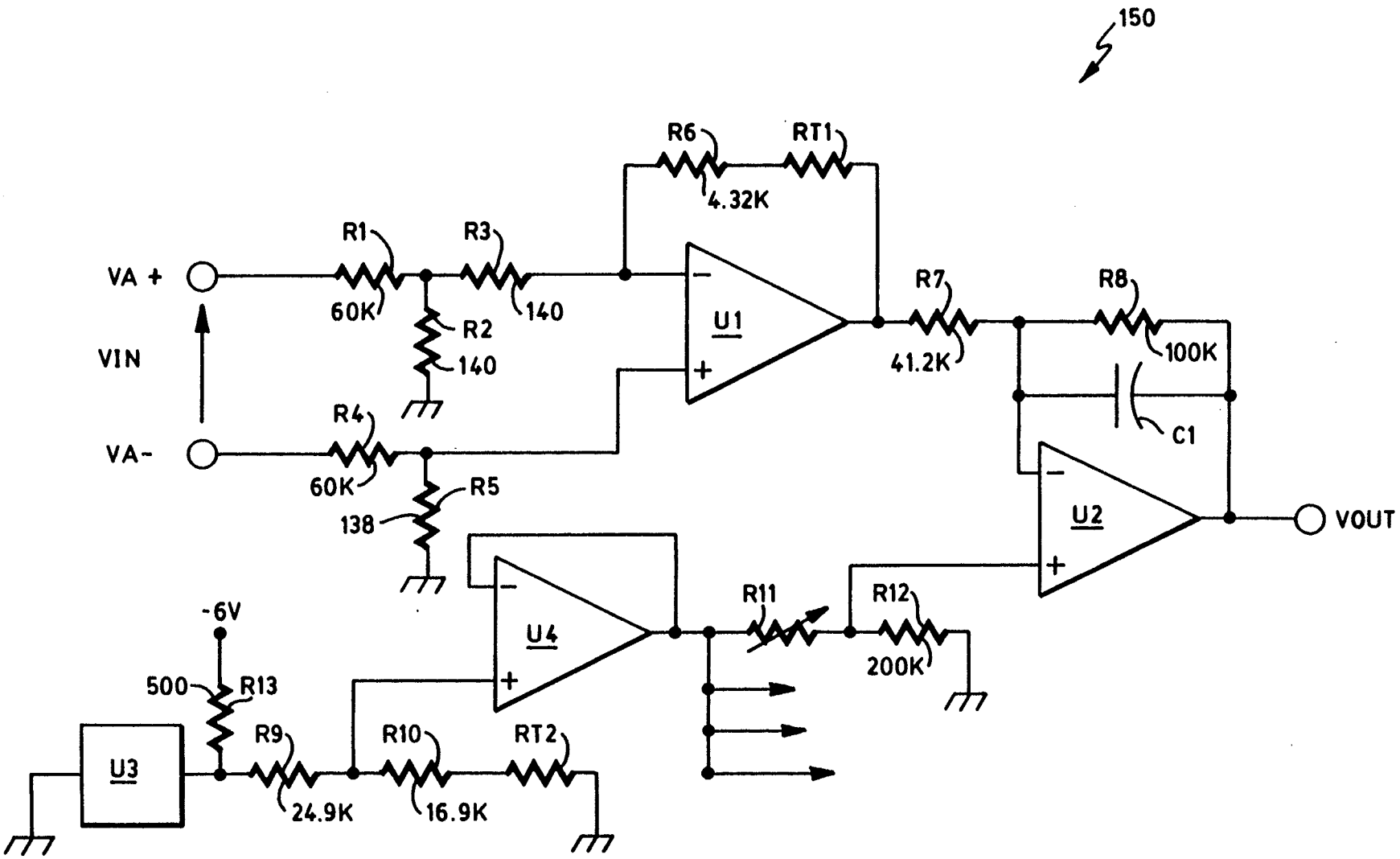
FIG. 5 is a schematic diagram of a temperature compensating driver circuit utilized as part of a control circuit to control a respective voltage variable attenuator.

Referring now also to FIG. 5, a schematic diagram of a control circuit 150 which is a portion of the driver circuit 130 is shown. Within the driver circuit 130, a corresponding control circuit, like control circuit 150, is provided to control each one of the voltage variable attenuators 132, 134, 136 and 138, respectively. The driver circuit 150 is shown as a temperature compensation circuit to compensate for changes in attenuation due to temperature characteristics of the voltage variable attenuators 132, 134, 136 and 138 (FIG. 4). The driver circuit 150 translates an input voltage $V_{IN}$ to an output voltage $V_{OUT}$ (which is used as the attenuator control voltage) in accordance with the equation $V_{OUT} = A \cdot V_{IN} + B$ wherein the coefficient A indicates signal gain and the coefficient B indicates voltage offset, both being functions of temperature. At room temperature, an input voltage between zero and ten volts results in an output swing of about 1.24 volts allowing approximately 12 dB attenuation range for the voltage variable attenuators assuming a 10 dB/volt change at room temperature. In the present application, a corresponding driver circuit 150 is provided for each one of the voltage variable attenuators 132, 134, 136 and 138 (FIG. 4)

within the control circuit 130 (FIG. 4), but for ease of understanding only a single driver circuit is shown.

The driver circuit 150 includes operational amplifiers (op-amp) U1 and U2, each having an inverting input, a noninverting input and an output. The operational amplifier U1 is here ¼ of a LF147F manufactured by National Semiconductor. The operational amplifier U2 is here ½ of a LF412A manufactured by National Semiconductor. The driver circuit 150 also includes a voltage reference U3, here a LM185-2.5 manufactured by National Semiconductor and a voltage follower U4, here a LM110 manufactured by National Semiconductor. The voltage reference U3 and voltage follower U4, resistors R9, R10, R13 and thermistor RT2 are shared between the four channels of the control circuit 130 while all other components are duplicated four times.

The driver circuit consists of two active stages of amplification for each VVA (i.e. U1 and U2) which provide signal gain and offset voltage changes to the VVA control signal. The driver circuit input Vin is differential and is applied between resistors R1 and R4 (both of value 60 Kohms). The positive side of the input signal Vin is connected to the inverting terminal of op-amp U1 by way of R1, R2 (having a value of 140 ohms) and R3 (having a value of 140 ohms). The negative side of the input signal Vin is connected to the non-inverting terminal of op-amp U1 by way of R4 and R5 (having a value of 138 ohms). The values of R1, R2, R3, R4 and R5 were chosen so that signal gain for the positive and negative sides of the input signal Vin are equal and opposite, thus providing a common-mode noise rejection feature.

Resistor R6 (having a value of 4.32 Kohms) and thermistor RT1, here an SH9302 1800 ohm positive temperature coefficient (PTC) thermistor manufactured by Quality Thermistor, Inc. of Boise Id., form a negative feedback network for op-amp U1. This feedback network, together with resistor R3, controls the gain of op-amp U1, to allow it to operate as a linear, inverting amplifier. The temperature dependence of the R6/RT1 network (due to RT1) sets up the temperature dependence of the coefficient "A" (the signal gain) in the equation $V_{OUT}=A\cdot V_{IN}+B$.

The output of op-amp U1 is connected to the inverting input of op-amp U2 through resistor R7 (having a value of 41.2 Kohms). Resistor R8 (having a value of 100 Kohms) and capacitor C1 (0.018 μF) form a negative feedback network for op-amp U2, which provides single-pole filtering with a −3 dB point of 88 Hz to negate the effects of noise pick-up on the signal Vin. Resistors R7 and R8 control the gain of the op-amp U2, to allow it to operate as a linear, inverting amplifier. The output of op-amp U2 provides the signal Vout, which is the control voltage for the corresponding one of the VVAs 132, 134, 136 or 138 (FIG. 4).

A temperature-dependent offset voltage is connected to the non-inverting input of op-amp U2. This voltage originates at the voltage reference U3, which provides a stable −2.5 volt output with a temperature coefficient typically less than +/−30 ppm/degree Celsius. Resistor R13 (having a value of 500 ohms) sources the voltage reference U3 from a regulated (but more temperature variable) −6 volt power supply which is not shown. Resistors R9 (having a value of 24.9 Kohms), R10 (having a value of 16.9 Kohms) and thermistor RT2, here also an SH9302 PTC thermistor, form a voltage divider network which sets up the temperature dependence of the coefficient "B" (the offset voltage) in the equation $V_{OUT}=A\cdot V_{IN}+B$. Voltage follower U4 provides unit gain to the output of the divider network R9/R10/RT2, so that the four driver circuits for the VVSa 132, 134, 136 and 138 will not interact by loading down the offset voltage.

A second divider network is configured at the output of voltage follower U4, consisting of R11 (variable between 0 and 160 Kohms) and R12 (having a value of 200 Kohms). The purpose of this network is to allow independent, nominal adjustment to the driver circuit offset voltage (coefficient "B" in the equation Vout=A*Vin+B) to accommodate the particular VVA being drive. For a typical VVA, the value of R11 is 80 Kohms.

With such an arrangement, if the ambient temperature should change, then the driver circuit 150 will change the reference voltage fed to the corresponding voltage variable attenuator to compensate for a change in attenuation due to temperature change. Such a result provides a constant attenuation by the voltage variable attenuator experiencing large changes in ambient temperature.

Having described the preferred embodiments of the invention, it will now become apparent to one of skill in the art that other embodiments incorporating their concepts may be used. For example, a plurality of voltage variable attenuators can be connected to a corresponding plurality of amplifiers with each of the voltage variable attenuators adjusted to correct for dissimilar amplification levels among the plurality of amplifiers to provide similar amplification levels in each amplification path. It is felt, therefore, that these embodiments should not be limited to the disclosed embodiments, but rather should be limited only by the spirit and scope of the appended claims.

What is claimed is:

1. A voltage variable attenuator comprising:

(a) a quadrature hybrid coupler having an input port, an output port, a first reflective port and a second reflective port; and (b) an impedance network coupled to the first reflective port, the impedance network comprising:

(i) a first RF propagation network having a first end coupled to the first reflective port of the quadrature hybrid coupler and a second end;

(ii) a field effect transistor having a source electrode, a drain electrode and a gate electrode, the drain electrode coupled to the second end of the first RF propagation network; and (iii) a second RF propagation network having a first end coupled to the source electrode and a second electrode coupled to a ground.

2. The voltage variable attenuator as recited in claim 1 further comprising:

a second impedance network coupled to the second reflective port, the second impedance network comprising:

(a) a third RF propagation network having a first end coupled to the second reflective port of the quadrature hybrid coupler and a second end;

(b) a second field effect transistor having a source electrode, a drain electrode and a gate electrode, the drain electrode of the second field effect transistor coupled to the second end of the second RF propagation network; and (c) a fourth RF propagation network having a first end coupled to the source electrode of the second field effect transistor and a second electrode coupled to the ground.

3. The voltage variable attenuator as recite din claim 1 wherein the quadrature hybrid coupler comprises a Lange type quadrature hybrid coupler.

4. The voltage variable attenuator as recited in claim 1 wherein the field effect transistor comprises a pair of MESFET type field effect transistors, a first one of the pair of MESFET type field effect transistors having a source electrode and a second one of the pair of MESFET type field effect transistors having a drain electrode, and a common electrode functioning as a drain electrode of the first one of the pair of MESFET type field effect transistors and the source electrode of the second one of the pair of MESFET type field effect transistors.

5. A voltage variable attenuator comprising:

(a) means, having a first, a second, a third and a fourth port, for coupling any signal fed to the first port to the second and third port and for coupling any signals fed to the second and third port to the fourth port;

(b) first means, responsive to a control signal and connected to the second port of the coupling means, for attenuating a predetermined portion of a signal incident thereto in response to the control signal; and (c) second means, responsive to the control signal and connected to the third port of the coupling means, for attenuating a predetermined portion of a signal incident thereto in response to the control signal, the first and second attenuating means each attenuating a similar predetermined portion of the signal incident thereto.

6. The voltage variable attenuator as recited in claim 5 wherein the coupling means comprises a Lange type quadrature hybrid coupler.

7. The voltage variable attenuator as recited in claim 5 wherein each one of the attenuating means comprises:

(a) a first RF propagation network having a first end coupled to the coupling means and a second end;

(b) a field effect transistor having a source electrode, a drain electrode and a gate electrode, the drain electrode coupled to the second end of the first RF propagation network; and (c) a second RF propagation network having a first end coupled to the source electrode of the field effect transistor and a second electrode coupled to a ground.

8. The voltage variable attenuator as recited in claim 7 wherein the field effect transistor comprises a pair of MESFET type field effect transistors, a first one of the pair of MESFET type field effect transistors having a source electrode and a second one of the pair of MESFET type field effect transistors having a drain electrode, and a common electrode functioning as a drain electrode of the first one of the pair of MESFET type field effect transistors and the source electrode of the second one of the pair of MESFET type field effect transistors.

9. The voltage variable attenuator as recited in claim 8 wherein the pair of MESFET type field effect transistors having a channel resistance is adapted such that the channel resistance varies with a gate voltage applied to the pair of MESFET type field effect transistors as necessary to provide the resistance required to approximate a predetermined resistance curve.

10. A circuit comprising:

a plurality of amplifiers; and a corresponding plurality of voltage variable attenuators, each voltage variable attenuator connected to a corresponding one of the plurality of amplifiers, each voltage variable attenuator comprising:

(a) means, having a first, a second, a third and a fourth port, for coupling any signal fed to the first port to the second and third port and for coupling any signals fed to the second and third port to the fourth port;

(b) first means, responsive to a control signal and connected to the second port of the coupling means, for attenuating a predetermined portion of a signal incident thereto in response to the control signal; and (c) second means, responsive to the control signal and connected to the third port of the coupling means, for attenuating a predetermined portion of a signal incident thereto in response to the control signal, the first and second attenuating means each attenuating a similar predetermined portion of the signal incident thereto.

11. The circuit as recited in claim 10 further comprising a control circuit means for providing a plurality of control signals for controlling each one of the plurality of voltage variable attenuators.

12. The voltage variable attenuator as recited in claim 1 wherein the field effect transistor comprises means for providing a channel resistance per gate voltage characteristic which corresponds with a predetermined resistance vs. attenuation characteristic for the voltage variable attenuator.

13. The voltage variable attenuator as recited in claim 7 wherein the field effect transistor comprises means for providing a channel resistance per gate voltage characteristic which corresponds with a predetermined resistance vs. attenuation characteristic for the voltage variable attenuator.

* * * * *